US010082314B2

(12) United States Patent
Mehta et al.

(10) Patent No.: US 10,082,314 B2
(45) Date of Patent: Sep. 25, 2018

(54) SOUND ENCLOSURE FOR A COMPRESSOR

(71) Applicant: TRANE INTERNATIONAL INC., Piscataway, NJ (US)

(72) Inventors: Pavak Anilbhai Mehta, LaCrescent, MN (US); John Scott Hausmann, LaCrosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 755 days.

(21) Appl. No.: 13/970,325

(22) Filed: Aug. 19, 2013

(65) Prior Publication Data

US 2014/0050572 A1 Feb. 20, 2014

Related U.S. Application Data

(60) Provisional application No. 61/684,293, filed on Aug. 17, 2012.

(51) Int. Cl.
*A47B 81/06* (2006.01)
*G10K 11/04* (2006.01)
(Continued)

(52) U.S. Cl.
CPC ..... *F24F 13/24* (2013.01); *F04C 29/06* (2013.01); *F04D 29/40* (2013.01); *F04D 29/664* (2013.01); *F24F 2013/242* (2013.01)

(58) Field of Classification Search
CPC . F04B 39/0033; F04B 53/002; F25B 2500/12
(Continued)

(56) References Cited

U.S. PATENT DOCUMENTS 4,508,486 A 4/1985 Tinker
5,252,035 A 10/1993 Lee
(Continued)

FOREIGN PATENT DOCUMENTS

JP 55-45084 3/1980
JP 2007-035043 2/1995
(Continued)

OTHER PUBLICATIONS

International Search Report for PCT/US2013/055601 dated Dec. 17, 2013, 3 pages.
(Continued)

*Primary Examiner* — Filip Zec
(74) *Attorney, Agent, or Firm* — Hamre, Schumann, Mueller & Larson, P.C.

(57) ABSTRACT

A sound enclosure of a compressor to attenuate an operational sound level of the compressor is disclosed. The sound enclosure may be configured to generally enclose the compressor and attenuate radiantly emitted sound by the compressor. The sound enclosure may be configured to include a plurality of assembly sections, particularly two side sections and one bottom section, where the two side sections can be joined together like two halves of a clam shell and joined to the bottom section to facilitate easy assembly. The sound enclosure may form openings at longitudinal ends of the sound enclosure to accommodate refrigerant lines. The assembly sections of the sound enclosure may include one or more openings to accommodate a compressor junction box, wire bundles, oil lines, mounting mechanisms, etc.

19 Claims, 7 Drawing Sheets

(51) Int. Cl.

| | |
|---|---|
| ***H02K 5/24*** | (2006.01) |
| ***F24F 13/24*** | (2006.01) |
| ***F04D 29/40*** | (2006.01) |
| ***F04D 29/66*** | (2006.01) |
| ***F04C 29/06*** | (2006.01) |

(58) Field of Classification Search
USPC ..... 181/198, 200, 202
See application file for complete search history.

(56) References Cited

U.S. PATENT DOCUMENTS

| | | | | |
|---|---|---|---|---|
| 5,272,285 | A | 12/1993 | Miller | |
| 5,274,200 | A | 12/1993 | Das et al. | |
| 5,391,054 | A * | 2/1995 | Bush | F04B 39/0033 220/DIG. 13 |
| 5,538,404 | A * | 7/1996 | DiFlora | F04B 39/121 181/200 |
| 5,588,810 | A | 12/1996 | DiFlora et al. | |
| 5,694,926 | A | 12/1997 | DeVries et al. | |
| 5,804,775 | A | 9/1998 | Pinnington | |
| 5,997,258 | A * | 12/1999 | Sawyer | F04B 39/0033 181/202 |
| 6,062,033 | A * | 5/2000 | Choi | F04B 39/0033 417/312 |
| 6,116,374 | A | 9/2000 | Westerbeke, Jr. | |
| 6,145,616 | A | 11/2000 | Ewanek | |
| 6,322,339 | B1 * | 11/2001 | Mitsunaga | F04C 18/0215 418/100 |
| 7,278,834 | B2 * | 10/2007 | Herrick | F04B 39/0044 248/638 |
| 7,318,608 | B2 | 1/2008 | Swartz et al. | |
| 7,357,219 | B2 | 4/2008 | Mafi et al. | |
| 7,526,903 | B2 | 5/2009 | Kandasamy | |
| 7,845,463 | B2 | 12/2010 | Yabe et al. | |
| 8,061,475 | B2 | 11/2011 | Mori et al. | |
| 2005/0167189 | A1 | 8/2005 | Aisenbrey | |
| 2005/0274569 | A1 | 12/2005 | Seel | |
| 2006/0144637 | A1 * | 7/2006 | Swartz | F01C 21/10 181/198 |
| 2006/0283657 | A1 | 12/2006 | Dubensky et al. | |
| 2007/0169504 | A1 * | 7/2007 | Vinocur | F16K 3/312 62/408 |
| 2008/0063512 | A1 * | 3/2008 | Nakamura | F04B 39/0027 415/119 |
| 2008/0099274 | A1 * | 5/2008 | Seel | H02K 5/24 181/202 |
| 2008/0099275 | A1 | 5/2008 | Seel | |
| 2009/0065299 | A1 | 3/2009 | Vito et al. | |
| 2010/0070085 | A1 * | 3/2010 | Harrod | F24F 11/0086 700/276 |
| 2010/0116583 | A1 | 5/2010 | Seedorf | |
| 2011/0017544 | A1 | 1/2011 | Bodwell et al. | |
| 2011/0067949 | A1 | 3/2011 | Mori et al. | |
| 2012/0193505 | A1 | 8/2012 | Baron | |
| 2012/0251357 | A1 | 10/2012 | Yokoi et al. | |
| 2012/0279245 | A1 | 11/2012 | Subramaniam et al. | |

FOREIGN PATENT DOCUMENTS

| | | |
|---|---|---|
| JP | 2000-199482 | 7/2000 |
| JP | 2009-293905 | 12/2009 |

OTHER PUBLICATIONS

Written for PCT/US2013/055601 dated Dec. 17, 2013, 8 pages.
U.S. Final Office Action for U.S. Appl. No. 14/422,138, dated Dec. 16, 2015, 20 pgs.
U.S. Non-final Office Action for U.S. Appl. No. 14/422,138, dated May 6, 2016 (19 pages).
U.S. Final Office Action for U.S. Appl. No. 14/422,138, dated Sep. 8, 2016 (20 pages).
Office Action, U.S. Appl. No. 14/422,138, dated Feb. 9, 2017 (19 pages).
Advisory Action, U.S. Appl. No. 14/422,138, dated Mar. 23, 2016 (6 pages).

* cited by examiner

SOUND ENCLOSURE FOR A COMPRESSOR

FIELD OF TECHNOLOGY

Embodiments disclosed herein relate generally to a heating, ventilation and air conditioning (HVAC) system. More specifically, embodiments disclosed herein relate generally to a sound enclosure for a compressor of a HVAC system to attenuate an operational sound level of the compressor.

BACKGROUND

When in operation, a compressor of a HVAC system can generate vibration and sound. For example, in a chiller system, the compressor is one of the main sources of operational sound. The operational sound of the compressor can migrate to other parts of the HVAC system through, for example, refrigerant lines. The operational sound of the compressor can also be emitted radiantly to the environment.

SUMMARY

A sound enclosure for a compressor of a HVAC system to attenuate an operational sound level of the compressor is disclosed herein. In some embodiments, the sound enclosure may include a first side section and a second side section, and a bottom section. In some embodiments, the sound enclosure is configured to extend in a longitudinal direction to enclose the compressor of the HVAC system and impede operational sound from the compressor, for example emitted radiantly by the compressor. In some embodiments, the sound enclosure may include one end opening in the longitudinal direction that is configured to allow refrigerant line access to the compressor.

In some embodiments, the sound enclosure is configured to have a three-piece construction: two side sections and one bottom section; or a two-piece construction: two side sections. In some embodiments, the pieces of the sound enclosure can be generally fastened together by, for example, screws, latches, quarter turn screws, etc.

In some embodiments, the sound enclosure is configured to have at least one opening to accommodate a compressor junction box for the compressor of the HVAC system. In some embodiments, the first side section, the second side section and the bottom section have overlapped portions. In some embodiments, the first side section, the second side section and the bottom section are joined to each other at the overlapped portions. In some embodiments, the first side section, the second side section or the bottom section of the sound enclosure may include at least one opening to accommodate a wire and/or a refrigerant line that are configured to be connected to the compressor of the HVAC system. In some embodiments, the bottom section of the sound enclosure may include a plurality of apertures to accommodate a mounting mechanism for the compressor of the HVAC system.

A chiller system with a sound enclosure may include longitudinal end openings on the sound enclosure and the end openings are configured to accommodate refrigerant lines coupled to the compressor. In some embodiments, the compressor of the chiller system may be supported by a mounting mechanism through an aperture of a bottom section of the sound enclosure. In some embodiments, the mounting mechanism may be attached to a supporting beam of the chiller system directly. In some embodiments, the mounting mechanism supporting the compressor of the chiller system may be configured to impede sound transmission between the compressor and the supporting beam of the chiller system.

In some embodiments, the sound enclosure may include a side section that is configured to have an opening to accommodate a compressor junction box for the compressor. In some embodiments, the sound enclosure of the chiller system may be configured to impede operational sound, for example that may be radiantly emitted by the compressor. In some embodiments, the refrigerant lines of the compressor may be equipped with sound isolating devices that are configured to impede sound transmission between the compressor and the refrigerant lines.

Other features and aspects of the embodiments will become apparent by consideration of the following detailed description and accompanying drawings.

BRIEF DESCRIPTION OF THE DRAWINGS

FIG. 6A is a perspective view of the sound enclosure with end plugs detached. FIG. 6B is a cut-away side view of the sound enclosure.

DETAILED DESCRIPTION

When in operation, a compressor of a HVAC system may generate sound. The sound of the compressor can migrate to other parts of the HVAC system through, for example, refrigerant lines, and can also be emitted radiantly to the environment.

In the following description of the illustrated embodiments, a sound enclosure of a compressor is disclosed. The sound enclosure may be configured to generally enclose the compressor and attenuate sound from the compressor, for example, sound that may be radiantly emitted by the compressor. The sound enclosure may be configured to include a plurality of assembly sections, particularly two side sections and one bottom section, where the two side sections can be joined together like two halves of a clam shell, and joined to the bottom section to facilitate easy assembly. The side sections and the bottom section of the sound enclosure may form end openings at longitudinal ends of the sound enclosure to accommodate refrigerant lines. The assembly sections of the sound enclosure may include one or more openings to accommodate a compressor junction box, wire bundles, oil lines, mounting mechanisms, etc. The sound enclosure can be used to attenuate the operational sound level of a compressor of a HVAC system, such as a screw compressor. The sound enclosure can also be applied to other types of compressors, when it is desirable to attenuate the operational sound levels. In some embodiments, the sound enclosure may be configured to attenuate sound particularly from a range of about 250 Hz to about 2000 Hz, which generally is the range of sound frequency for the operational sound of the compressor.

References are made to the accompanying drawings that form a part hereof, and in which is shown by way of illustration of the embodiments may be practiced. It is to be understood that the terms used herein are for the purpose of describing the figures and embodiments and should not be regarded as limiting the scope of the present application.

Figure 1:
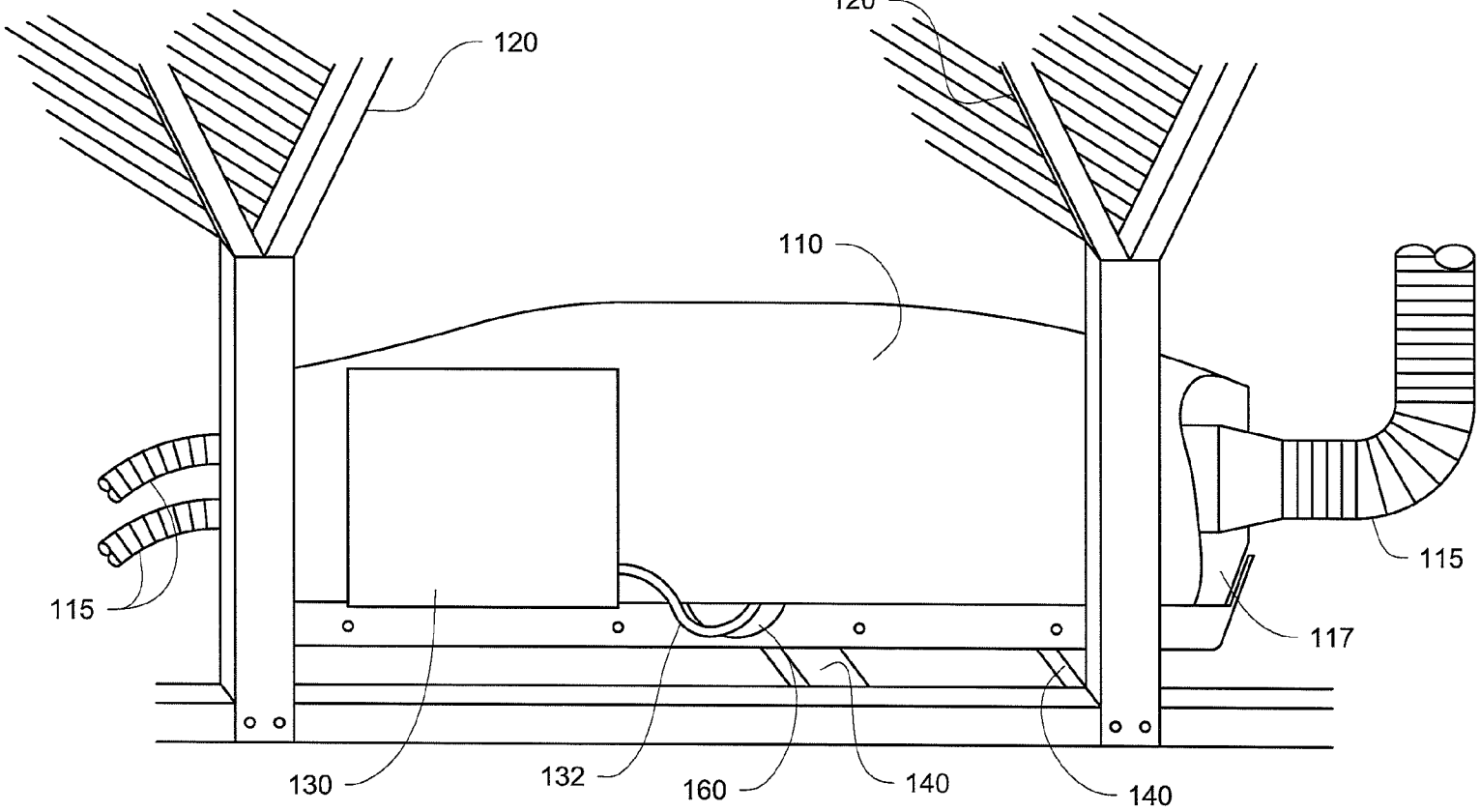
FIG. 1 illustrates a partial view of a HVAC system with a compressor enclosed by a sound enclosure.

FIG. 1 illustrates a chiller system 100 with a compressor that is enclosed in a sound enclosure 110. The sound enclosure 110 is generally located at a lower part of the chiller system 100. The compressor is connected to refrigerant lines 115 that extend out of the sound enclosure 110 through an opening(s) 117 of the sound enclosure 110. The chiller system 100 also includes condenser coils 120 that are generally positioned in an upper part of the chiller system. The sound enclosure 110 also accommodates a compressor junction box 130. The compressor junction box 130 is coupled to the compressor by wire bundle 132 through an opening 160, for example, on a side of the enclosure 110. The sound enclosure 110 may be supported by supporting beams 140 that are positioned underneath the sound enclosure 110.

It is to be appreciated that the chiller system 100 as illustrated in FIG. 1 is exemplary. The chiller system may be configured differently. Generally, the sound enclosure is configured to accommodate a compressor of a chiller system and the sound enclosure may include an opening(s) to allow refrigerant lines to extend out of the sound enclosure. Further, the sound enclosure may also be configured to have openings and/or apertures to support a compressor junction box, wire bundles, oil lines, mounting mechanisms, etc. The sound enclosure as described herein may be configured to be suitable for compressors of a HVAC system, such as a screw compressor.

Figure 2A:
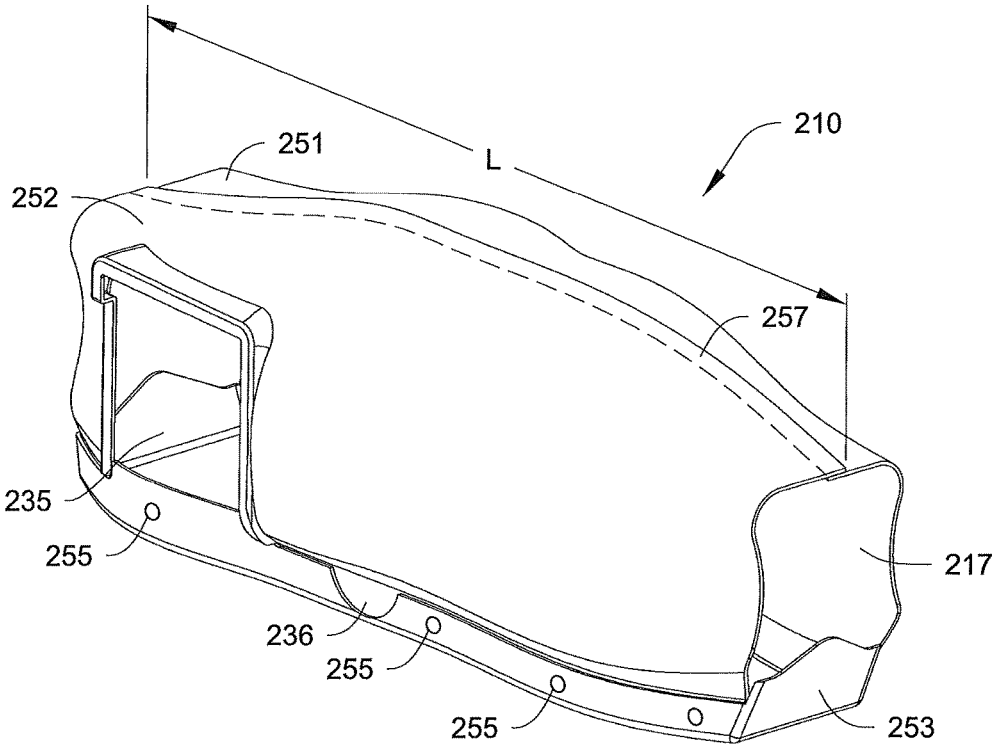
FIGS. 2A and 2B are elevated views of one embodiment of a sound enclosure.
Figure 2B:
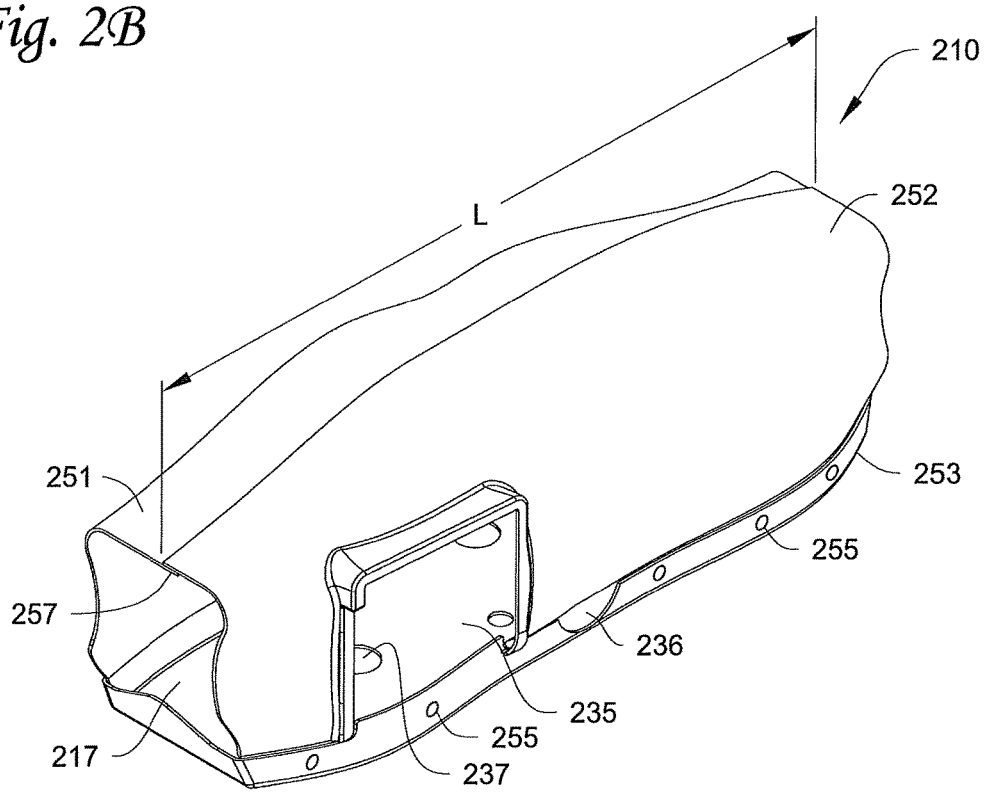

Referring to FIGS. 2A and 2B, elevated views of one embodiment of a sound enclosure 210 are illustrated. The sound enclosure 210 includes a plurality of assembly sections: side sections 251 and 252, and bottom section 253. In the illustrated embodiment, both of the side sections 251 and 252 are joined to the bottom sections 253 by, for example, a plurality of bolts 255. The side sections 251 and 252 have an overlapping section 257, in which the two side sections 251 and 252 can be joined together.

The side sections 251 and 252, and the bottom section 253 of the sound enclosure 210 form openings 217 on both ends of the sound enclosure 210 in a longitudinal direction of the sound enclosure 210 that is defined by a length L. When the sound enclosure 210 is installed to a HVAC system to enclose a compressor of the HVAC system, the longitudinal direction of the sound enclosure 210 is about parallel to a refrigerant flow direction through the compressor.

The side section 252 may have an opening 235 that may be configured to accommodate a compressor junction box and/or wire bundles (such as the junction box 130 in FIG. 1). The bottom section may also have an opening 236 that may be configured to accommodate, for example, a compressor junction wire bundles. The bottom section 253 has a plurality of apertures 237 that may be configured to accommodate mounting mechanisms for a compressor. (See FIG. 4 and the description below for one example of the mounting mechanism.) In general, the sound enclosure 210 may be configured to have openings and/or apertures to accommodate wires and/or lines connected to the compressor.

Figure 3A:
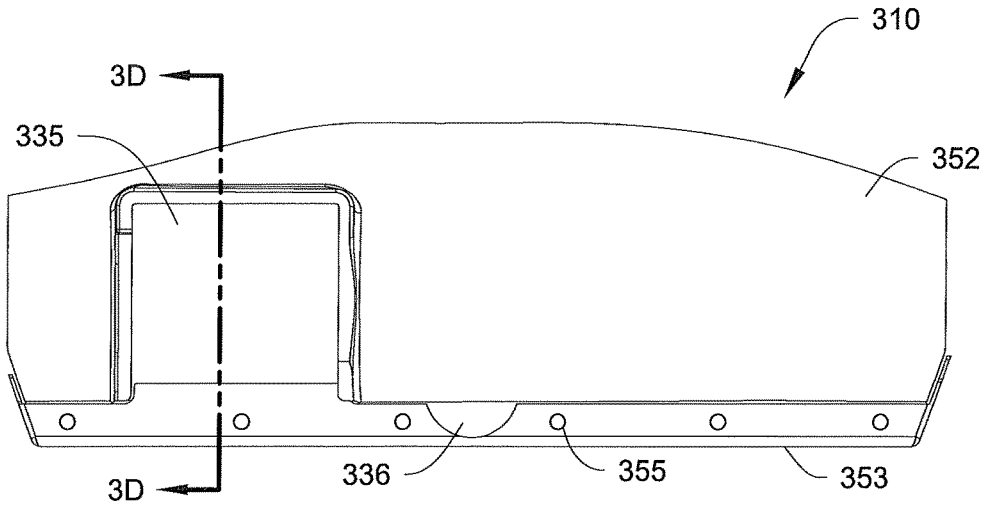
FIGS. 3A to 3D are different views of another embodiment of a sound enclosure.
Figure 3B:
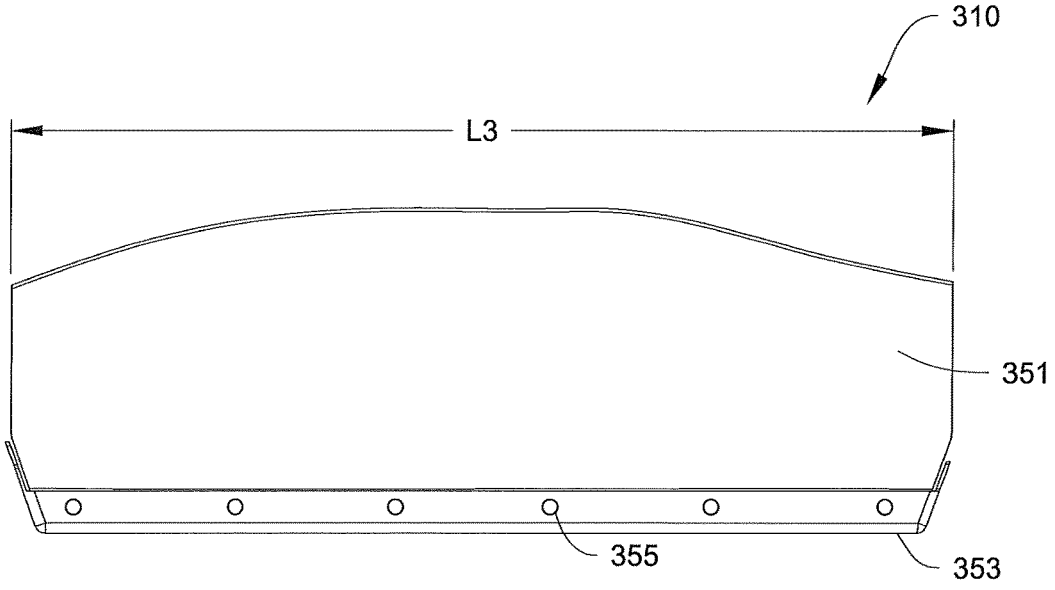

FIGS. 3A to 3D illustrate different views of a sound enclosure 310. FIGS. 3A and 3B are side views. The side views show that a side section 352 can be configured to have an opening 335. The opening 335 is configured to accommodate, for example, a compressor junction box 130 as illustrated in FIG. 1. A bottom section 353 is configured to have an opening 336. Side sections 351 and 352 are configured to be joined to the bottom section 353 through, for example, bolts 355.

Figure 3C:
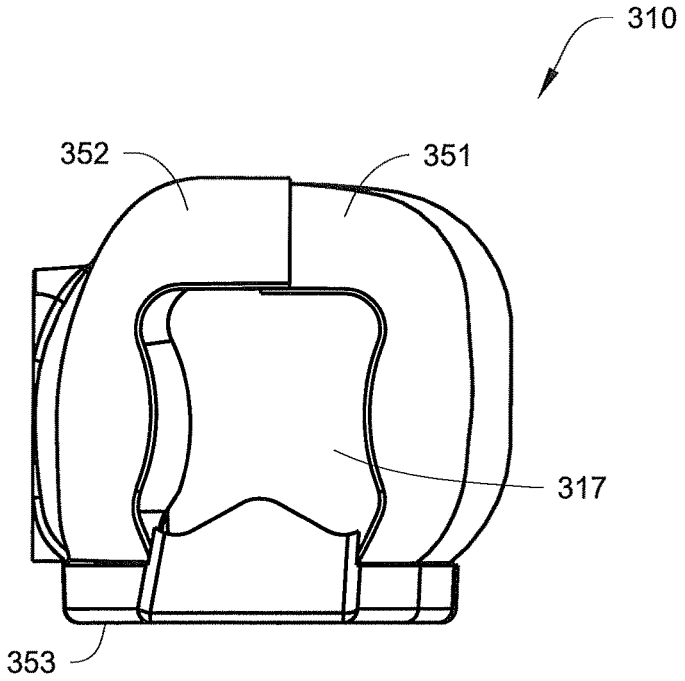

From the end view as illustrated in FIG. 3C, an opening 317 can be seen. The sound enclosure 310 can be configured to have two openings 317 located at both ends of a longitudinal direction of the sound enclosure 310 that is defined by a length L3 as shown in FIG. 3B.

Figure 3D:
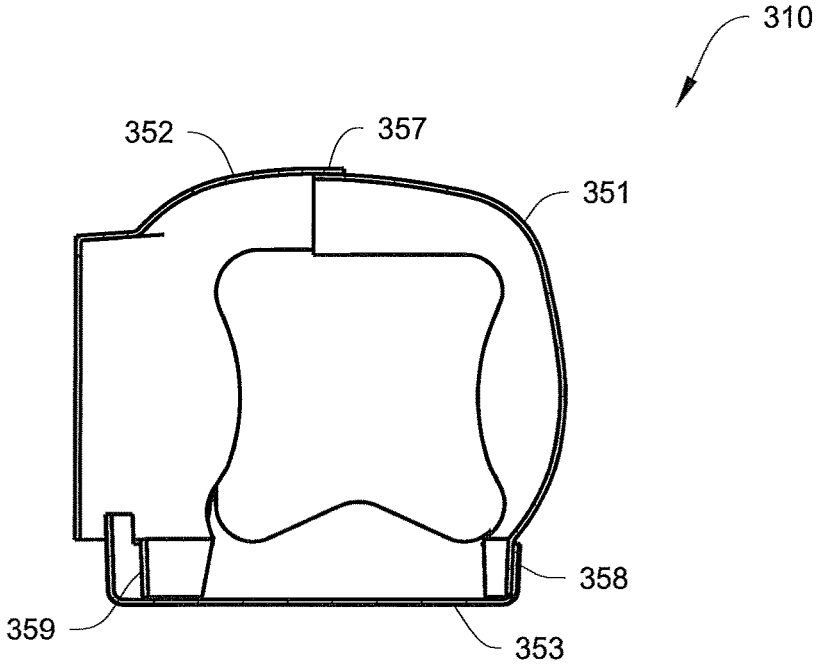

FIG. 3D illustrates a sectional view along line 3D-3D in FIG. 3A. The side sections 351 and 352 have an overlapped portion 357 and join together like two halves of a clam shell. The side section 351 and the bottom section 353 have an overlapped portion 358, and the side section 352 and the bottom section 353 have an overlapped portion 359.

As illustrated in FIGS. 3A, 3B (as well as FIG. 2B), the overlapping portion 357, 358 and/or 359 can extend the whole length L3 of the sound enclosure 310. The overlapped portions 357, 358 and 359 may help join the side sections 351 and 352, and the bottom section 353 together.

Different joining methods can be applied to the overlapped sections 357, 358 and 359 to facilitate joining the sections 351, 352 and 353 together. For example, the side sections 351, 352 and the bottom section 353 can be fastened together by, for example, screws, latches and quarter turn screws. It will be appreciated that the method of fastening and the type of fasteners are not limited, as other suitable fastener may be employed. The holding methods can be reversible so that the sound enclosure 310 can be dissembled if necessary.

It is to be appreciated that the side sections 352 and 353 can be one integrated piece, rather than two separate pieces. In addition, the side sections 351 and 352 may also be configured to have a curved profile from the side views (as illustrated in FIGS. 3A and 3B) and/or from the end views (as illustrated in FIGS. 3C and 3D). The profiles of the side sections 351 and 352 may help the sound closure 310 to stay close to other components of a HVAC system when installed.

Figure 4:
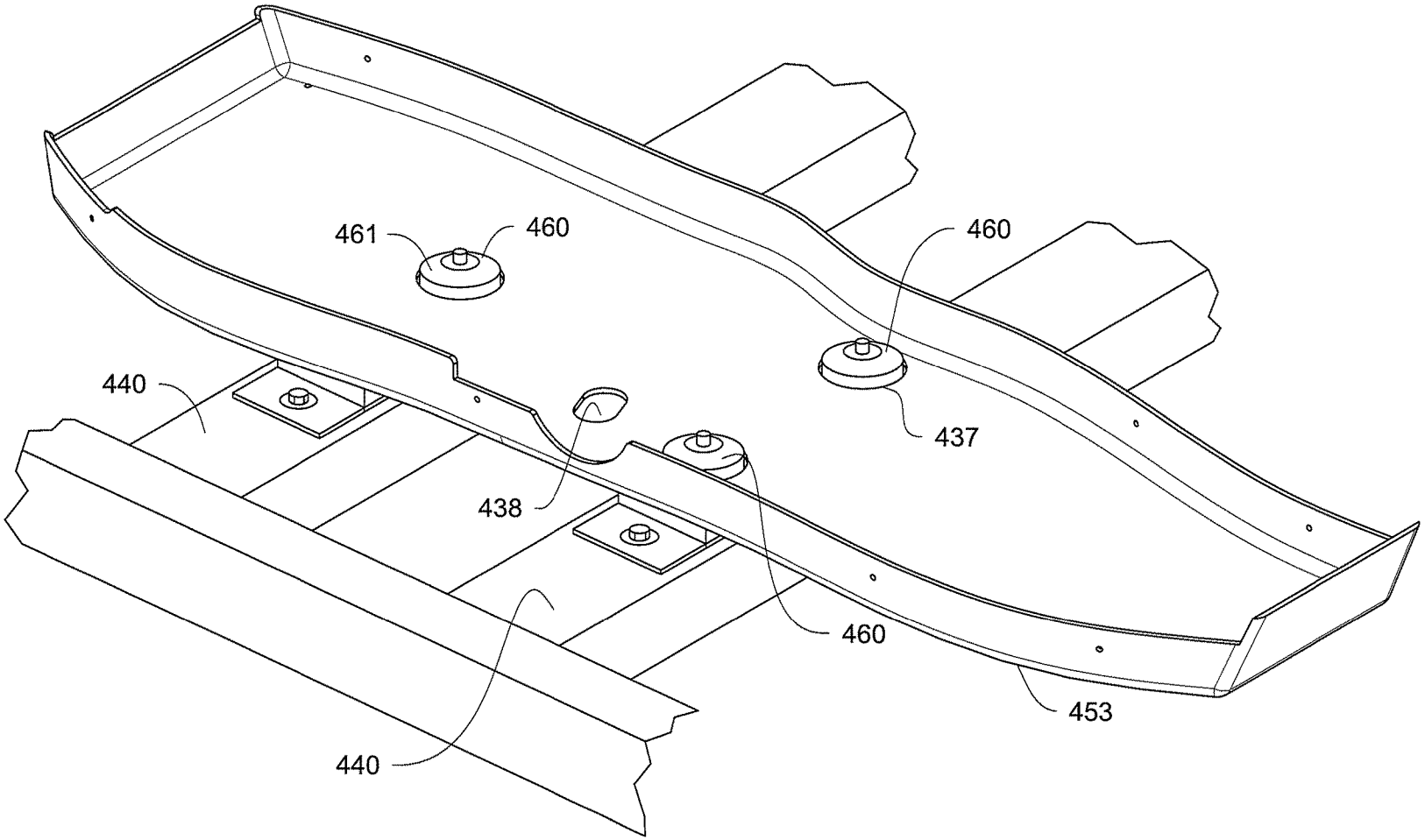
FIG. 4 illustrates a bottom section of a sound enclosure that is installed in a chiller system.

FIG. 4 illustrates a bottom section 453 that is assembled to supporting beams 440 of a chiller system. The supporting beams 440 are generally positioned underneath the bottom section 453. The bottom section 453 may have a plurality of apertures 437 that are configured to accommodate mounting mechanisms 460 to support a compressor (not shown).

Each of the mounting mechanisms 460 includes a sound isolator 461 that is positioned between the compressor and the supporting beams 440. The sound isolators 461 support the compressor and are configured to impede vibration transmission between the compressor and the supporting beam 440. The sound isolators 461 may be made of sound damping materials, such as rubber. The sound isolators 461 as illustrated in FIG. 4 may be generally used to attenuate the operation noise of a compressor of a chiller system, such as a screw compressor. It is to be noted, the sound isolators may also be used to install other suitable compressors to supporting beams. The compressors in the embodiments as illustrated in the Figures of this document can also use similar sound isolator to support the compressors.

When assembled, a portion of the bottom section 453 is positioned between the supporting beams 440 and the compressor. However, the bottom section 453 is configured so that the bottom section 453 does not contact the compressor directly.

The bottom section 453 is also configured to have an access opening 438. The access opening 438 may accommodate, for example, an oil line to the compressor. When in use, the sound enclosure as described herein may be used outdoors and may be subject to environmental elements, such as rain and snow. Consequently, water may get into the sound enclosure. Sometimes, condensation water may accumulate inside the sound enclosure. The bottom section 453 can also be configured to have an opening(s) similarly arranged and constructed as the openings 438, but used for drainage purposes. The bottom section 453 may also include openings different from the openings 438.

Figure 5:
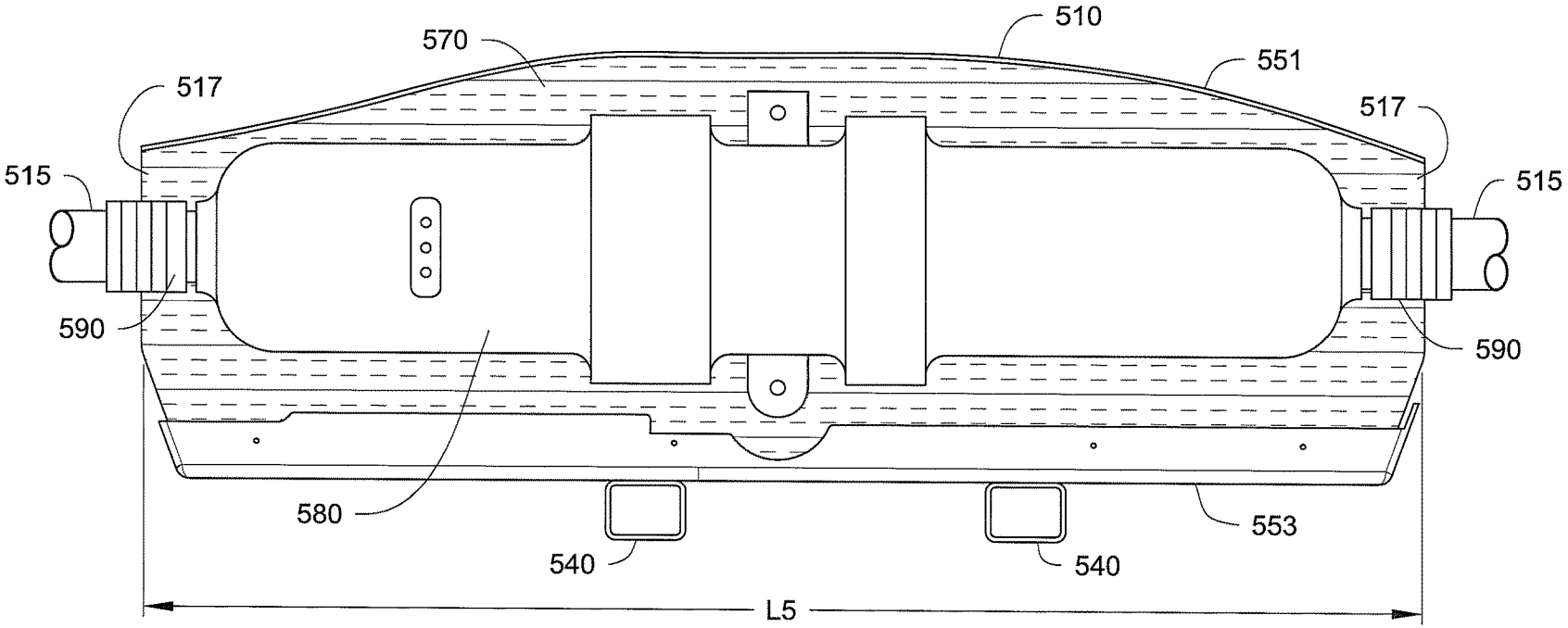
FIG. 5 illustrates cut-away side view of an assembled sound enclosure enclosing a compressor.

FIG. 5 illustrates a compressor 580 that is positioned in a sound enclosure 510. One side section of the sound assembly 510 is cut away for clearer illustration. The compressor 580 is generally enclosed by the sound enclosure 510. The compressor 580 is positioned so that the compressor 580 does not touch the sound enclosure 510 directly. The sound enclosure 510 generally extends in a longitudinal direction that is defined by a length L5. The longitudinal direction is generally about parallel to a refrigerant flow direction through the compressor 580. The sound enclosure 510, particularly a side section 551 (and the cut-away side section), has a surface contour that generally extends in the longitudinal direction and conforms to a profile of the compressor 580. In some embodiments, the surface contour can be configured so that the side section 551 maintains a relatively constant distance from an outline of the profile of the compressor 580.

In addition, an area between the compressor 580 and the sound enclosure 510 may contain sound damping materials, for example, foam 570. For example, in some embodiments, a layer(s) of the foam can be attached to an inner surface of the sound enclosure. In some embodiments, the area between the compressor 580 and the sound enclosure 510 may be filled or partially filled with the sound damping materials. In one embodiment, the sound damping material is attached to the sound enclosure 510 and has a space between the sound damping material and the compressor 580.

The sound damping materials can be fiber glass, rock wool, vinyl barriers, foam or other acoustics materials.

Two ends of the compressor 580 are equipped with in-line sound isolating devices 590 along the refrigerant lines 515, such as for example, devices with flexible bellow structures. The sound isolating devices 590 can impede transmission of the sound generated by the compressor 580 to the refrigerant lines 515 in the longitudinal direction that is defined by the length L5.

End openings 517 of the sound enclosure 510 are configured to accommodate the sound isolating devices 590 and/or refrigerant lines 515. Because the in-line sound isolating device 590 can impede transmission of the sound in the longitudinal direction, the end openings 517 may not necessarily to be configured to impede and/or attenuate sound. In one embodiment, the in-line sound isolating device 590 can include a heavy flange(s) that helps impede sound from transmitting out of the sound enclosure.

In operation, the compressor 580 can emit sound radiantly to the environment. The sound enclosure 517 and/or the foam 570 can impede and/or absorb sound emitted by the compressor 580 so as to attenuate an operational sound level of the compressor 580. In some embodiments, the compressor 580 can be a screw compressor.

The compressor 580 can be supported by, for example, sound isolators 461 that are illustrated in FIG. 4 at a bottom of the compressor 580. Consequently, the bottom of the compressor 580 generally does not touch a bottom section 553 of the sound enclosure 510.

The sound generated by the compressor 580 is isolated and/or absorbed by a plurality of mechanisms. In the longitudinal direction, the in-line sound isolating devices 590 are configured to impede sound transmission between the compressor 580 and the refrigerant lines 515. This in-line sound isolating device 590 can particularly help impede the structure borne sound. The compressor 580 is also isolated from the supporting beams 540 by sound isolators, such as the sound isolators 461 as illustrated in FIG. 4. The sound isolators 461 can impede sound transmission from the compressor to the supporting beams 540. Further, the sound enclosure 510 and/or foam 570 can impede and/or absorb sound emitted radiantly, such as air borne sound by the compressor 580 and/or the sound isolating devices 590. The sound enclosure 510 and/or foam 570 can particularly help impede air borne sound. In some embodiments, the sound enclosure 510 may be configured to attenuate sound particularly from a range of about 250 Hz to about 1000 Hz, which is the range of frequency for the operational sound of the compressor 580.

In some embodiments, the sound enclosure may be equipped with one or more end plugs (e.g. end plugs 660 in FIGS. 6A and 6B below) that are configured to plug the end openings 517 to provide another sound impeding layer for the air borne sound emitted by the compressor 580 and/or the sound isolating devices 590.

Figure 6A:
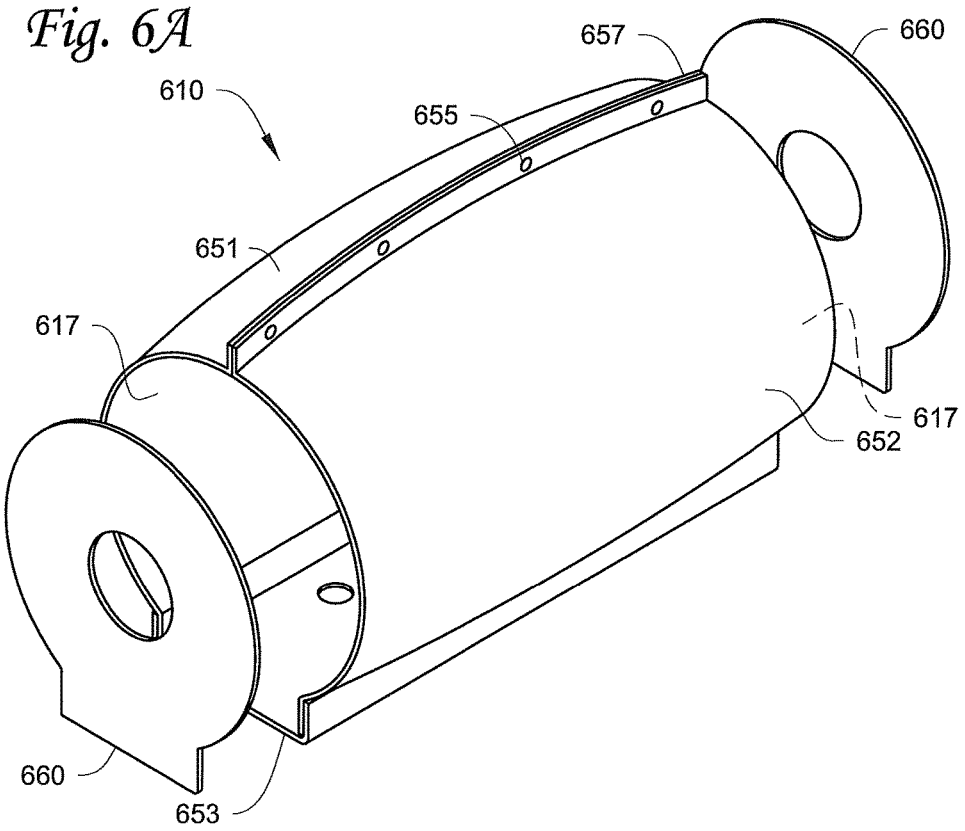
FIGS. 6A and 6B illustrate yet another embodiment of a sound enclosure.
Figure 6B:
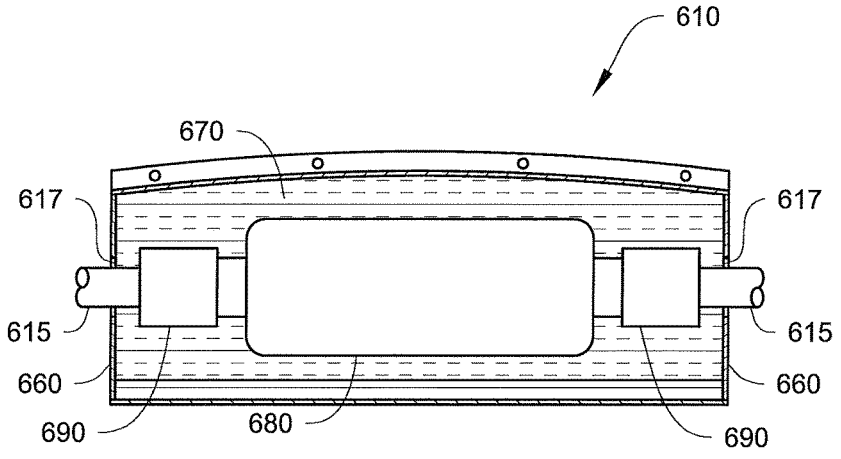

FIGS. 6A and 6B illustrate another embodiment of a sound enclosure 610. The sound enclosure is configured to have side sections 651 and 652, and a bottom section 653. The side sections 651 and 652 may be configured to have raised edges 657 so that the side sections 651 and 652 may be joined together by, for example, bolts 655 at the raised edges 657.

The sound enclosure 610 may also be equipped with end plugs 660. The end plugs 660 can be used to plug or cover the end openings of the sound enclosure 610. The end plugs 660 may be made of sound impeding materials, such as foam, to provide a further sound impeding layer to impede sound, particularly air borne sound.

A side schematic view of the sound enclosure 610 is illustrated in FIG. 6B. The sound enclosure 610 is configured to generally enclose a compressor 680 and in-line sound isolating devices 690. An area between the sound enclosure 610 and the compressor 680 and/or the sound isolating devices 690 may contain sound damping materials, such as foam 670. Longitudinal ends of the sound enclosure 610 have the openings 617 to allow refrigerant lines 615 to exit the sound enclosure 610. The openings 617 may not need to be configured to impede sound. As illustrated, the end plugs 660 are used from inside of the sound enclosure 610 to plug or cover the openings 617. It is noted that the sound plugs 660 may be also configured to cover the openings 617 from outside of the sound enclosure 610. The end plugs 660 also have openings to accommodate, for example, refrigerant lines.

The assembly sections of the sound enclosure may be molded. In some embodiments, the sound enclosure may include three sections: two side sections and one bottom sections as illustrated above. In some embodiments, the sound enclosure may include more or less than three sections, such as two side sections. Generally, the sound enclosure may include two side sections extending in a longitudinal direction that is generally parallel to a refrigerant flow direction through a compressor. The sound enclosure may also have a surface contour that conforms to a profile of the compressor. The two side sections may be assembled similar to two halves of a clam shell so as to accommodate a compressor. Because the sound enclosure can be assembled from just a few pieces, such as two or three, of side and/or bottom sections, the sound enclosure can be assembled relatively easily.

The sound enclosures as described herein may be generally configured to impede and/or absorb sound radiantly emitted by the compressor, while allow refrigerant line to access the compressor from openings at longitudinal ends of the sound enclosure. The sound enclosure may also be configured to have openings and apertures to accommodate compressor junction box, wire bundle, oil lines, etc. that are coupled to the compressor. A bottom of the sound enclosure may be configured to have openings to accommodate sound isolators supporting the compressor and isolating the compressor from supporting beams of a chiller system. The assembly sections may be separated from the compressor by a foam layer(s). The sound enclosure can also be configured to have a water drainage opening(s) to facilitate removal of water accumulation inside the sound enclosure.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What claimed is:

1. A sound enclosure for a screw compressor of an HVAC system, comprising:

a first side section and a second side section; and a bottom section;

wherein the sound enclosure is configured to enclose a screw compressor of the HVAC system in a longitudinal direction and impede operational sound emitted radiantly by the screw compressor, the longitudinal direction extending along a length of the sound enclosure and being about parallel to a refrigerant flow direction through the screw compressor, the length being larger than a height and a width of the sound enclosure, the first side section, the second side section and the bottom section form an end opening in each end of the sound enclosure in the longitudinal direction that is configured to allow a refrigerant line to access the enclosed compressor through each of the end openings, the length is a major dimension of the sound enclosure and extends from the end opening in one end of the sound enclosure to the end opening in a second end of the sound enclosure, the bottom section includes a plurality of apertures to accommodate a mounting mechanism for the screw compressor of the HVAC system, the mounting mechanism extending through the plurality of apertures and being securable to the screw compressor, the bottom section being configured so that the bottom section does not contact the screw compressor directly, the first side section and the second side section, the first side section and the bottom section, and the second side section and the bottom section have overlap sections, and the first side section and the second side section, the first side section and the bottom section, and the second side section and the bottom section are joined together at the overlap sections, and the sound enclosure is configured to create a space between the screw compressor relative to the first and second side sections and relative to the bottom section when the screw compressor is inside the sound enclosure.

2. The sound enclosure of claim 1, wherein the first side section or the second side section is configured to have at least one opening to accommodate a compressor junction box for the screw compressor of the HVAC system.

3. The sound enclosure of claim 1, wherein the first side section, the second side section or the bottom section include at least one opening to accommodate a wire or a refrigerant line that is configured to be connected to the screw compressor of the HVAC system.

4. The sound enclosure of claim 1, wherein the sound enclosure has a curved profile from a side view.

5. The sound enclosure of claim 1, wherein the bottom of the sound enclosure is configured to have a drainage opening.

6. A chiller system, comprising:

a screw compressor;

a frame;

a sound enclosure configured to enclose the screw compressor, the sound enclosure having longitudinal end openings in each end of the sound enclosure in a longitudinal direction, the longitudinal direction extending along a length of the sound enclosure and being about parallel to a refrigerant flow direction through the screw compressor, the length being larger than a height and a width of the sound enclosure, the length being a major dimension of the sound enclosure and extending from a first of the longitudinal end openings to a second of the longitudinal end openings; and refrigerant lines coupled to the screw compressor through the end openings;

wherein the screw compressor is supported by a mounting mechanism to the frame, the mounting mechanism extends through an aperture of a bottom section of the sound enclosure and is secured to the screw compressor, the bottom section configured so that the bottom section does not contact the screw compressor directly.

7. The chiller system of claim 6, wherein the sound enclosure includes a side section that is configured to have an opening to accommodate a compressor junction box for the screw compressor.

8. The chiller system of claim 6, wherein the sound enclosure is configured to impede operational sound radiantly emitted by the screw compressor.

9. The chiller system of claim 6, wherein the mounting mechanism supporting the screw compressor is configured to impede sound transmission between the screw compressor and a supporting beam of the chiller system.

10. The chiller system of claim 6, wherein the refrigerant lines of the screw compressor are equipped with in-line sound isolating devices that are configured to impede sound transmission between the screw compressor and the refrigerant lines.

11. The chiller system of claim 6, wherein a bottom of the sound enclosure is configured to have a drainage opening.

12. A sound enclosure of a screw compressor of an HVAC system, comprising:

a first side section and a second side section; and a bottom section;

wherein the sound enclosure is configured to enclose a screw compressor of the HVAC system and impede operational sound emitted radiantly by the screw compressor, the bottom section includes a plurality of apertures to accommodate a mounting mechanism for the screw compressor of the HVAC system, the plurality of apertures to accommodate the mounting mechanism, the mounting mechanism extending through the plurality of apertures and being securable to the screw compressor, the bottom section configured so that the bottom section does not contact the screw compressor directly, the first side section and the second side section, the first side section and the bottom section, and the second side section and the bottom section have overlap sections, and the first section and the second side section, the first side section and the bottom section, and the second side section and the bottom section are joined together at the overlap sections, the first side section, the second side section, and the bottom section form an end opening in each end of the sound enclosure in a longitudinal direction that are configured to allow a refrigerant line to access the enclosed screw compressor through each of the end openings, the longitudinal direction extending along a length of the sound enclosure and being about parallel to a refrigerant flow direction through the screw compressor, the length being larger than a height and a width of the sound enclosure, the length is a major dimension of the sound enclosure and extends from the end opening in one end of the sound enclosure to the end opening in a second end of the sound enclosure, and the sound enclosure is configured to have a space between the screw compressor relative to the first and second side sections and relative to the bottom section.

13. The sound enclosure of claim 1, further comprising an end plug insertable into one of the end openings.

14. The sound enclosure of claim 1, wherein in an end view, the overlap section between the first side section and the second side section is disposed at a top of the sound enclosure, a portion of one of the first and second side sections extends over a portion of the other of the first and second side portions, the overlap section extending in the longitudinal direction.

15. The sound enclosure of claim 1, wherein a plane extending from one of the end openings to the other of the end openings in the longitudinal direction is parallel to a major surface of the bottom section.

16. The sound enclosure of claim 1, wherein a plane extending from one of the end openings to the other of the end openings in the longitudinal direction does not intersect a major surface of the bottom section.

17. The sound enclosure of claim 1, wherein a variable surface contour of the first side section and a variable surface contour of the second side section are designed to follow a variable profile of the screw compressor, the variable surface contours being configured so that the first side section and the second side section maintain a relatively constant distance from an outline of the variable profile of the screw compressor when installed.

18. The chiller system of claim 6, wherein the sound enclosure includes first and second side sections, a variable surface contour of the first side section and a variable surface contour of the second side section are designed to follow a variable profile of the screw compressor, the variable surface contours being configured so that the first side section and the second side section maintain a relatively constant distance from an outline of the variable profile of the screw compressor when installed.

19. The sound enclosure of claim 12, wherein a variable surface contour of the first side section and a variable surface contour of the second side section are designed to follow a variable profile of the screw compressor, the variable surface contours being configured so that the first side section and the second side section maintain a relatively constant distance from an outline of the variable profile of the screw compressor when installed.

* * * * *